United States Patent [19]

Overgoor et al.

[11] Patent Number: 5,075,599

[45] Date of Patent: Dec. 24, 1991

[54] CIRCUIT ARRANGEMENT

[75] Inventors: Bernardus J. M. Overgoor; Johannes M. Van Meurs; Marcel Beij, all of Eindhoven, Netherlands

[73] Assignee: U. S. Philips Corporation, New York, N.Y.

[21] Appl. No.: 614,887

[22] Filed: Nov. 16, 1990

[30] Foreign Application Priority Data

Nov. 29, 1989 [NL] Netherlands ..... 8902940
May 31, 1990 [NL] Netherlands ..... 9001242

[51] Int. Cl.[5] ..... H05B 41/36

[52] U.S. Cl. ..... 315/224; 315/209 R; 315/307; 315/DIG. 7

[58] Field of Search ..... 315/224, 307, DIG. 7, 315/209 R, DIG. 9, 243; 363/109, 97, 131

[56] References Cited

U.S. PATENT DOCUMENTS 4,887,007 12/1989 Almering et al. ..... 315/224 X
4,949,016 8/1990 De Bijl et al. ..... 315/224 X
4,965,493 10/1990 Van Neurs et al. ..... 315/224

*Primary Examiner*—Eugene R. LaRoche
*Assistant Examiner*—Ali Neyzari

[57] ABSTRACT

The invention relates to a circuit arrangement for operating a discharge lamp, comprising a DC-AC converter provided with a switching element for generating a current whose polarity changes with a frequency f, a current sensor (SE), a drive circuit (III) for generating a drive signal to make the switching elements alternately conducting with the frequency f, a measuring circuit (I) coupled to the current sensor and having at least one switching element for generating a control signal which is dependent on a phase difference between a voltage across the load circuit B and a current through the load circuit B and on a second signal which is a measure for a minimum required phase difference, and a control circuit (II) for effecting a change in an operating condition of the DC-AC converter, this change being dependent on the control signal.

6 Claims, 2 Drawing Sheets

CIRCUIT ARRANGEMENT

The invention relates to a circuit arrangement for operating a discharge lamp, comprising a DC-AC converter provided with

- a circuit A comprising at least one switching element for generating a current with alternating polarity by being alternately conducting and non-conducting with a frequency f, and provided with terminals suitable for being connected to a DC voltage source,
- a load circuit B coupled to circuit A and comprising lamp connection terminals and inductive means,
- a drive circuit for generating a drive signal for making the switching element alternately conducting and non-conducting with the frequency f,
- a current sensor,
- a measuring circuit coupled to the current sensor and to the switching element for generating a control signal which is dependent on a phase difference between a voltage across the load circuit B and a current through the load circuit B, and
- a control circuit for effecting a change in an operating condition of the DC-AC converter, this change being dependent on the control signal.

Such a circuit arrangement is known from the European Patent Application 178852.

In the known circuit arrangement, the change in the operating condition consists of a change in the frequency f. If a lamp is operated by means of the known circuit arrangement, a current J whose polarity changes with the frequency f flows through the load circuit B, while a periodic potential Vp is present between the ends of the load circuit B with a repetition frequency which is also equal to f. In general, J will be ahead of or lag behind Vp. If J lags behind Vp, the operation is inductive and the phase difference between Vp and J is positive. If J is ahead of Vp, the operation is capacitive and the phase difference between Vp and J is negative.

A large power dissipation occurs in the switching elements in the case of capacitive operation. This may even give rise to damage. Capacitive operation of the DC-AC converter, therefore, is generally undesirable.

In contrast to capacitive operation, inductive operation means that the switching element of circuit A is made conductive while a relatively low voltage is present across the switching element, so that the power dissipation occurring in the switching element is relatively low. Capacitive operation of a DC-AC converter can occur, for example, owing to the fact that the characteristics of one or several of the components from which load circuit B is formed change during the life of these components. Capacitive operation can also occur, for example, if there is no lamp between the connection terminals while a current is flowing through the load circuit B.

Relatively long operation is prevented in the case of operation by means of the known circuit arrangement in that the control circuit changes the frequency f the moment the measuring circuit detects capacitive operation. Depending on, for example, the type of switching element in circuit A, however, capacitive operation of the switching element for no more than one or a few period(s) of the frequency f can already cause damage to the switching element.

The invention has for its object to provide a circuit arrangement with which a large power dissipation and damage to components of the DC-AC converter owing to capacitive operation are prevented, in that the time interval during which the circuit arrangement will be in capacitive operation, when capacitive operation occurs, is made very short.

This object is achieved in that the change in the operating condition of the DC-AC converter in the circuit arrangement of the kind mentioned in the opening paragraph consists in that the switching element is made non-conducting during the remaining portion of a period belonging to the frequency f of the switching element. This change in the operating condition of the DC-AC converter can be achieved very quickly. It was found that, thanks to this quick change, capacitive operation in a circuit arrangement according to the invention occurs for only very small periods, or not at all, in practice, even in the case of an abrupt change in the switching arrangement's connected load.

It is possible in the measuring circuit to use a reference signal which is a measure for a minimum required phase difference: the control signal activates the control circuit if the phase difference between Vp and J is smaller than the minimum required phase difference.

The minimum required phase difference value may be chosen to be zero because this phase difference value forms the boundary between capacitive and inductive operation. A disadvantage of the value zero for the minimum required phase difference, however, is that the measuring circuit does not activate the control circuit until after the DC-AC converter has entered the capacitive state. Since a certain time interval is required for generating the control signal and effecting the change in the operating condition of the DC-AC converter, it is generally desirable to choose the minimum required phase difference value to be greater than zero. If the control signal is generated periodically instead of continuously, it is generally desirable to choose the minimum required phase difference value to be greater in proportion as the period between two subsequent values of the control signal is greater.

The value of the current through the current sensor at the moment at which a switching element is made non-conducting is a measure for the phase difference between the periodic potential Vp and the current J. This renders it possible to design the measuring circuit in the following way. The measuring circuit comprises a comparator of which a first input is coupled to the current sensor, while the reference signal is present at another input, the control signal being dependent on the drive signal and on an output signal of the comparator. The signal present at the first input is derived from the current through the current sensor. The reference signal acts as a second signal, which is a measure for a minimum required phase difference. Thus a portion of the measuring circuit is realised in a simple and reliable manner.

In an advantageous embodiment of a circuit arrangement according to the invention, the DC-AC converter is an incomplete half-bridge circuit and the current sensor forms part of the load circuit B. An advantage of this is that the current J flows substantially continuously through circuit B during a period of Vp. If the current sensor forms part of circuit A, current will only flow through the current sensor during half of each period of Vp. For this reason, a measurement of the phase difference between Vp and J can only take place during that half of each period of Vp in which the current sensor passes current. If, however, the current sensor forms part of circuit B, the phase difference between Vp and J can be measured in both halves of each period of Vp. This renders it possible to choose the interval time between two subsequent measurements to be very small.

A special embodiment of a circuit arrangement according to the invention is characterized in that the current sensor is coupled to a circuit for controlling the power consumed by the lamp by the adjustment of the frequency f with which the drive signal renders the switching elements alternately conducting. If such a DC-AC converter is used, the power consumed by the lamp is controllable while at the same time any capacitive operation caused by a frequency change will be of very short duration.

Embodiments of the invention will be explained in more detail with reference to the accompanying drawing.

Figure 1:
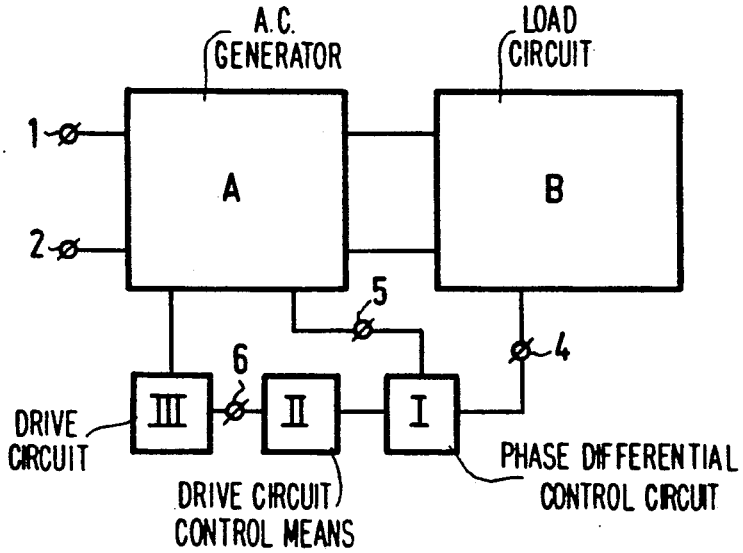
FIG. 1 is a diagrammatic picture of the arrangement of an embodiment of a circuit arrangement according to the invention.

In FIG. 1, reference numeral 1 denotes a first terminal of a circuit A and 2 denotes a further terminal of circuit A. 1 and 2 are suitable for being connected to the terminals of a DC voltage source. Circuit A comprises a switching element for generating a current of alternating polarity by being alternately conducting and non-conducting with a frequency f. B is a load circuit comprising inductive means and lamp connection terminals. Load circuit B is coupled to circuit A. A lamp La is connected to the lamp connection terminals.

III denotes a drive circuit for generating a drive signal for making the switching element of circuit A alternately conducting and non-conducting.

I is a measuring circuit for generating a control signal which is dependent on a phase difference between a voltage across the load circuit B and a current through the load circuit B.

To this end, the measuring circuit I is coupled to a current sensor and to a switching element of circuit A. An output of measuring circuit I is connected to an input of control circuit II. Control circuit II is a circuit for rendering the switching element non-conducting for the remainder of a period belonging to the frequency f of the switching element. To this end, an output of control circuit II is connected to an input of drive circuit III. Drive circuit III is connected to the switching elements of circuit A.

The operation of the circuit arrangement shown in FIG. 1 is as follows.

When the input terminals 1 and 2 are connected to poles of a DC voltage source, the drive circuit renders the switching element in circuit A alternately conducting and non-conducting with a frequency f. As a result, a current J flows through the load circuit with a polarity which changes with the frequency f, while a periodic voltage is present between the ends of the load circuit B. In general, there will be a phase difference between the periodic voltage $V_p$ and the current J. The measuring circuit I generates a control signal which is dependent on this phase difference. Depending on the control signal, the control circuit II will render the switching element non-conducting for the remainder of a period belonging to the frequency f of the switching element.

Figure 2:
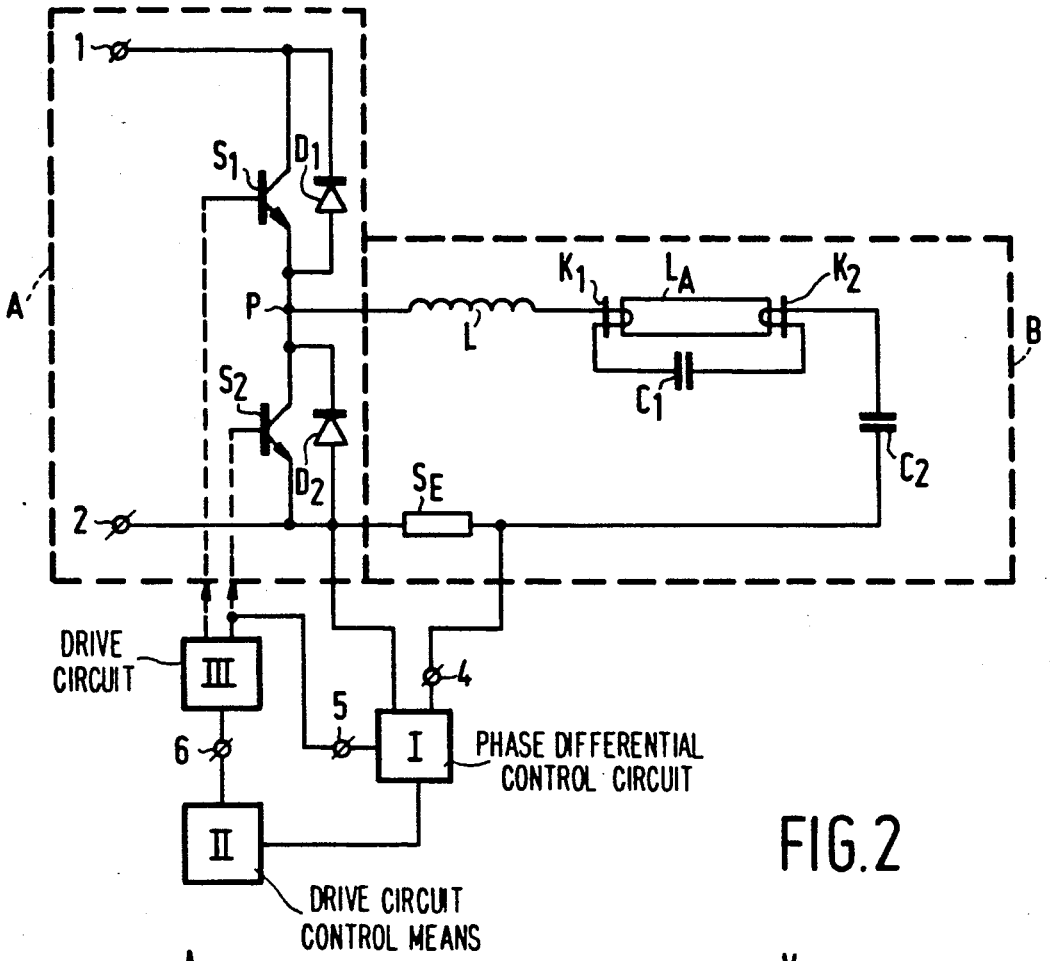
FIG. 2 shows further details of the embodiment shown in FIG. 1.

In FIG. 2, the circuit A is formed by ends 1 and 2, switching elements S1 and S2, and diodes D1 and D2. Load circuit B consists of a coil L, lamp connection terminals K1 and K2, capacitors C1 and C2, and a current sensor SE. A lamp La may be connected to the load circuit. The coil L in this embodiment forms the inductive means. Input terminals 1 and 2 are interconnected by a series circuit of switching elements S1 and S2 in such a way that a main electrode of switching element S1 is connected to terminal 1 and a main electrode of switching element S2 to terminal 2. Switching element S1 is shunted by a diode D1 in such a way that an anode of the diode D1 is connected to a common point P of the two switching elements S1 and S2. Switching element S2 is shunted by a diode D2 in such a way that an anode of the diode D2 is connected to terminal 2.

Switching element S2 is also shunted by a series circuit comprising the coil L, connection terminal K1, lamp La, connection terminal K2, capacitor C2, and current sensor SE, which in the embodiment shown is formed by a resistor. The lamp La is shunted by the capacitor C1. Both ends of the sensor SE are connected to separate inputs of the measuring circuit I. A further input of the measuring circuit I is connected to a control electrode of a switching element. An output of the drive circuit III is connected to a control electrode of the switching element S1, and a second output of the drive circuit III is connected to a control electrode of the switching element S2.

The operation of the DC-AC converter shown in FIG. 2 is as follows.

When the terminals 1 and 2 are connected to poles of a DC voltage source, the drive signal makes the switching elements S1 and S2 alternately conducting with a repetition frequency f. Thus a common point P of the two switching elements is alternately connected to the negative and the positive pole of the DC voltage source. As a result, a substantially square-wave voltage Vp is present at point P with a repetition frequency f. This substantially square-wave voltage Vp causes a current J, whose polarity changes with the repetition frequency f, to flow in load circuit B. Between Vp and J there exists a phase difference which depends on the repetition frequency f. The measuring circuit I generates a control signal which depends on the phase difference between the substantially square-wave voltage Vp and the current J. Depending on the control signal, the control circuit makes a switching element non-conducting for the remainder of the period belonging to the frequency f of the switching element. Rendering a switching element non conducting substantially coincides in time with a rising or falling edge of the substantially square-wave voltage Vp. This renders it possible, for example, to control the phase difference between the substantially square-wave voltage Vp and the alternating current J by making a conducting switching element non-conducting if the absolute instantaneous value of the alternating current J falls to below a reference level which is a measure for a minimum required phase difference.

Figure 3:
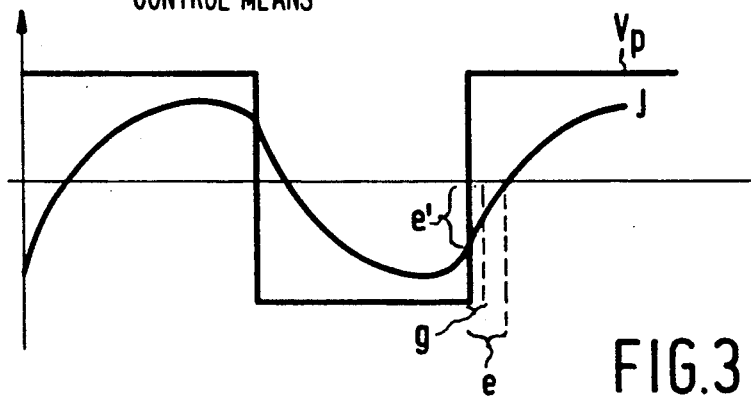
FIGS. 3 and 4 show the shapes of voltages and currents in the DC-AC converter shown in FIGS. 1 and 2.
Figure 4:
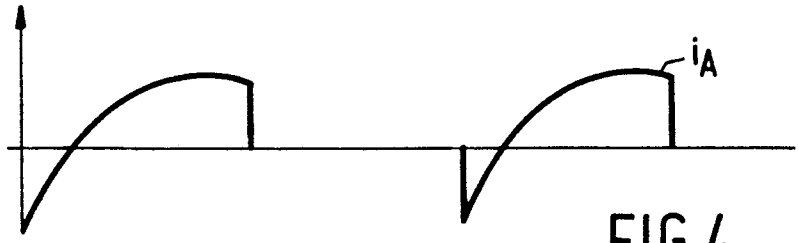

In FIGS. 3 and 4, the horizontal axis shows the time dimension in relative measure and the vertical axis the current or voltage dimension in relative measure. J is the current flowing in the load circuit B. Vp is the substantially square-wave voltage present at the common point P of the two switching elements S1 and S2. In the situation shown, the current J lags behind the voltage Vp in phase, so that inductive operation obtains. e is the phase difference between Vp and J and g is a minimum required phase difference between Vp and J. e' is an instantaneous value of the current J coinciding in time with a rising edge of Vp; e' at the same time is a measure for the phase difference between Vp and J.

In FIG. 4, iA is a current in circuit A. This current does not flow during one half of each period of Vp.

Figure 5:
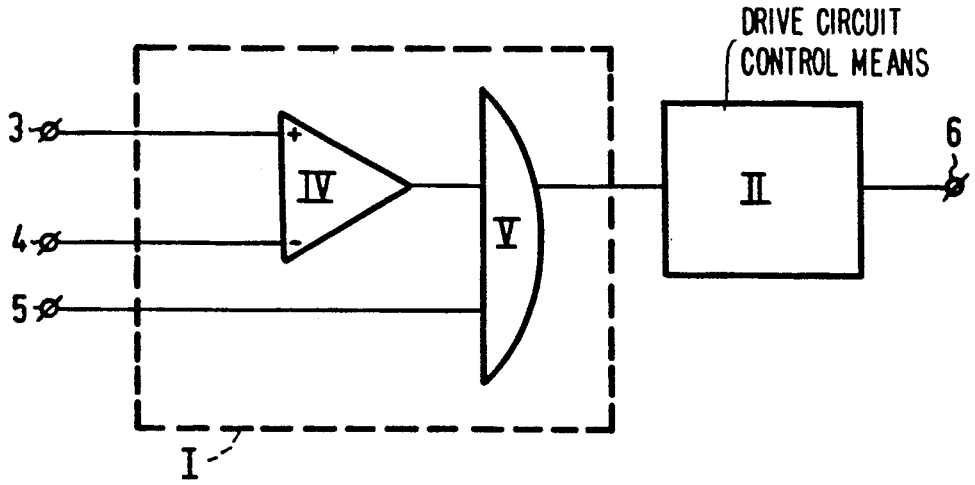
FIG. 5 shows a preferred embodiment of the measuring circuit I.

In FIG. 5, IV is a comparator having inputs 3 and 4. An output of the comparator IV is connected to an input of logic AND gate V. Reference numeral 5 denotes another input of logic AND gate V. An output of V is connected to an input of control circuit II.

Of the inputs 3 and 4, input 4 is coupled to the current sensor SE while at input 3 a reference signal is present which is a measure for a minimum required value of the phase difference between Vp and J. Input 5 is coupled to a control electrode of a switching element.

When the current J changes over from positive to negative, the operation of the circuit shown in FIG. 5 is as follows.

When the current through the current sensor decreases, the value of the signal present at input 4 drops to below the value of the reference signal present at input 3. This causes the signal at the output of comparator IV to change from low to high. If the corresponding switching element, S1 or S2, is conducting, the signal at input 5 is high, so that also the signal at the output of the logic AND gate V changes from low to high. The signal at the output of logic AND gate V in this embodiment of the measuring circuit is the control signal and activates the control circuit II so that it renders the then conducting switching element non-conducting.

If the phase difference between the periodic voltage Vp and the alternating current J is greater than the minimum required value, the signal at input 5 is low at the moment at which the signal at the output of comparator IV changes from low to high, since the relevant switching element is non-conducting then. In this situation the control signal at the output of logic AND gate V remains low and the control circuit II is not activated.

In a manner analogous to the one described above for checking the phase difference at the moment the current J changes from positive to negative, it is possible to carry out the check with the same measuring circuit through an adaptation of the signals present at the inputs 3, 4 and 5 when the current J changes from negative to positive. In this way it is possible to carry out the phase difference check twice every cycle of the alternating current J.

In a practical embodiment of a circuit arrangement according to the invention, the measuring circuit was designed as shown in FIG. 5. The frequency f was 28 kHz. It was found to be possible to remove a burning lamp from the lamp connection terminals without this abrupt change in the load of the circuit arrangement resulting in capacitive operation of the DC-AC converter.

We claim:

1. A gas discharge lamp control circuit arrangement for operating a discharge lamp, comprising a DC-AC converter provided with a circuit A comprising at least one switching element for generating a current with alternating polarity by being alternately conducting and non-conducting with a frequency f, and provided with terminals suitable for being connected to a DC voltage source, a load circuit B coupled to circuit A and comprising lamp connection terminals and inductive means, a drive circuit for generating a drive signal for making the switching element alternately conducting and non-conducting with the frequency f, a current sensor, a measuring circuit coupled to the current sensor and to the switching element for generating a control signal which is dependent on a phase difference between a voltage across the load circuit B and a current through the load circuit B, and a control circuit for effecting a change in an operating condition of the DC-AC converter, this change being dependent on the control signal, characterized in that the change in the operating condition of the DC-AC converter consists in that the switching element is made non-conducting during the remaining portion of a period belonging to the frequency f of the switching element.

2. A circuit arrangement as claimed in claim 1, characterized in that the control signal is dependent on a reference signal which is a measure for a minimum required phase difference.

3. A circuit arrangement as claimed in claim 2, characterized in that the measuring circuit comprises a comparator of which an input is coupled to the current sensor, while the reference signal is present at another input, the control signal being dependent on the drive signal and on an output signal of the comparator.

4. A circuit arrangement as claimed in claim 1, 2 or 3, characterized in that the DC-AC converter is an incomplete half-bridge circuit and the current sensor forms part of the load circuit B.

5. A circuit arrangement as claimed in claim 1, 2 or 3, characterized in that the current sensor is coupled to a circuit for controlling the power consumed by the lamp through the adjustment of the frequency f with which the drive signal renders the switching elements alternately conducting.

6. A circuit arrangement as claimed in claim 4, characterized in that the current sensor is coupled to a circuit for controlling the power consumed by the lamp through the adjustment of the frequency f with which the drive signal renders the switching elements alternatively conducting.

* * * * *